US007021895B2

(12) United States Patent
Rubenstein et al.

(10) Patent No.: US 7,021,895 B2
(45) Date of Patent: Apr. 4, 2006

(54) FAN MODULE WITH INTEGRATED DIFFUSER

(75) Inventors: Brandon Rubenstein, Loveland, CO (US); Bradley Clements, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 363 days.

(21) Appl. No.: 10/292,989

(22) Filed: Nov. 13, 2002

(65) Prior Publication Data

US 2004/0091355 A1 May 13, 2004

(51) Int. Cl.
*F04D 29/54* (2006.01)

(52) U.S. Cl. ..... 415/207; 415/220

(58) Field of Classification Search ..... 415/119–220, 415/244 R, 210 R; 416/294 R, 210 R
See application file for complete search history.

(56) References Cited

U.S. PATENT DOCUMENTS 1,497,408 A * 6/1924 Seelig ..... 415/207
3,334,807 A * 8/1967 McMahan ..... 415/207
4,061,188 A * 12/1977 Beck ..... 165/122
4,173,995 A * 11/1979 Beck ..... 165/51
4,189,281 A * 2/1980 Katagiri et al. ..... 415/222
4,413,947 A * 11/1983 Seki ..... 415/220
4,859,140 A * 8/1989 Passadore ..... 415/48
4,909,711 A * 3/1990 Burgbacher et al. ..... 417/354
5,695,318 A * 12/1997 Harmsen ..... 415/218.1
6,003,239 A * 12/1999 Liebenthal et al. ..... 34/97
6,752,587 B1 * 6/2004 Lin et al. ..... 415/220

OTHER PUBLICATIONS

Panasonic fan model FBA09A12U.

* cited by examiner

*Primary Examiner*—Edward K. Look
*Assistant Examiner*—Richard A Edgar

(57) ABSTRACT

Disclosed is a fan module. In one embodiment, the fan module includes a fan having an inlet end and an exit end, and a fan housing in which the fan is positioned, the fan housing including at least one angled interior wall adjacent the exit end of the fan that diffuses air downstream of the fan.

29 Claims, 6 Drawing Sheets

FAN MODULE WITH INTEGRATED DIFFUSER

BACKGROUND

Computers normally come packaged in a cabinet commonly referred to as "box." This is true both for personal computers (PCs) as well as server computers. Many of the various electrical components within the computer box generate heat while operating. For example, heat is typically generated by power supplies, hard drives, and circuit boards disposed within computer boxes.

To avoid overheating of the electrical components within a computer box, fans are typically used that draw and/or blow air over the heat-generating components. The airflow created by these fans provides forced convection that transfers heat from the heat-generating components to the ambient air. Normally, the heated air is permitted to exit the computer box through one or more exhaust vents, typically provided at the rear of the computer box.

Space is often limited in computer boxes, especially in situations in which many different electrical components are to be housed within the box, as in the case of server computers. Due to these space constraints, components to be provided within a given computer box occasionally must be reduced in size to ensure that they will fit properly within the computer box. For example, in the case of fans, smaller diameter fans than would be optimal for purposes of heat dissipation may need to be used. In such a case, the heat-generating components may not be provided with the degree of heat transfer that is required. Therefore, the computer designer may be faced with the equally undesirable choices of providing potentially inadequate heat transfer, or redesigning the entire computer layout or increasing the size of the computer box to provide the space required to accommodate the properly-sized fans.

SUMMARY

Disclosed is a fan module. In one embodiment, the fan module includes a fan having an inlet end and an exit end, and a fan housing in which the fan is positioned, the fan housing including at least one angled interior wall adjacent the exit end of the fan that diffuses air downstream of the fan.

BRIEF DESCRIPTION OF THE DRAWINGS

The disclosed fan module can be better understood with reference to the following drawings. The components in the drawings are not necessarily to scale.

DETAILED DESCRIPTION

As described above, space constraints may require the computer designer to reduce the size of components of a given computer, including fans used therein, to ensure that they will fit within the computer box. In the case of reducing the size of fans used in a computer, inadequate heat dissipation may result. Proper heat dissipation can be achieved, however, when the fan modules used include integrated diffusers that diffuse the airflow downstream of the fan modules so that an airflow covering a greater area is generated.

Disclosed herein is a fan module that includes an integrated diffuser. Although specific embodiments of the fan module are shown in the figures and described herein, these embodiments are provided for purposes of example only to describe construction and operation of the fan module.

Figure 1:
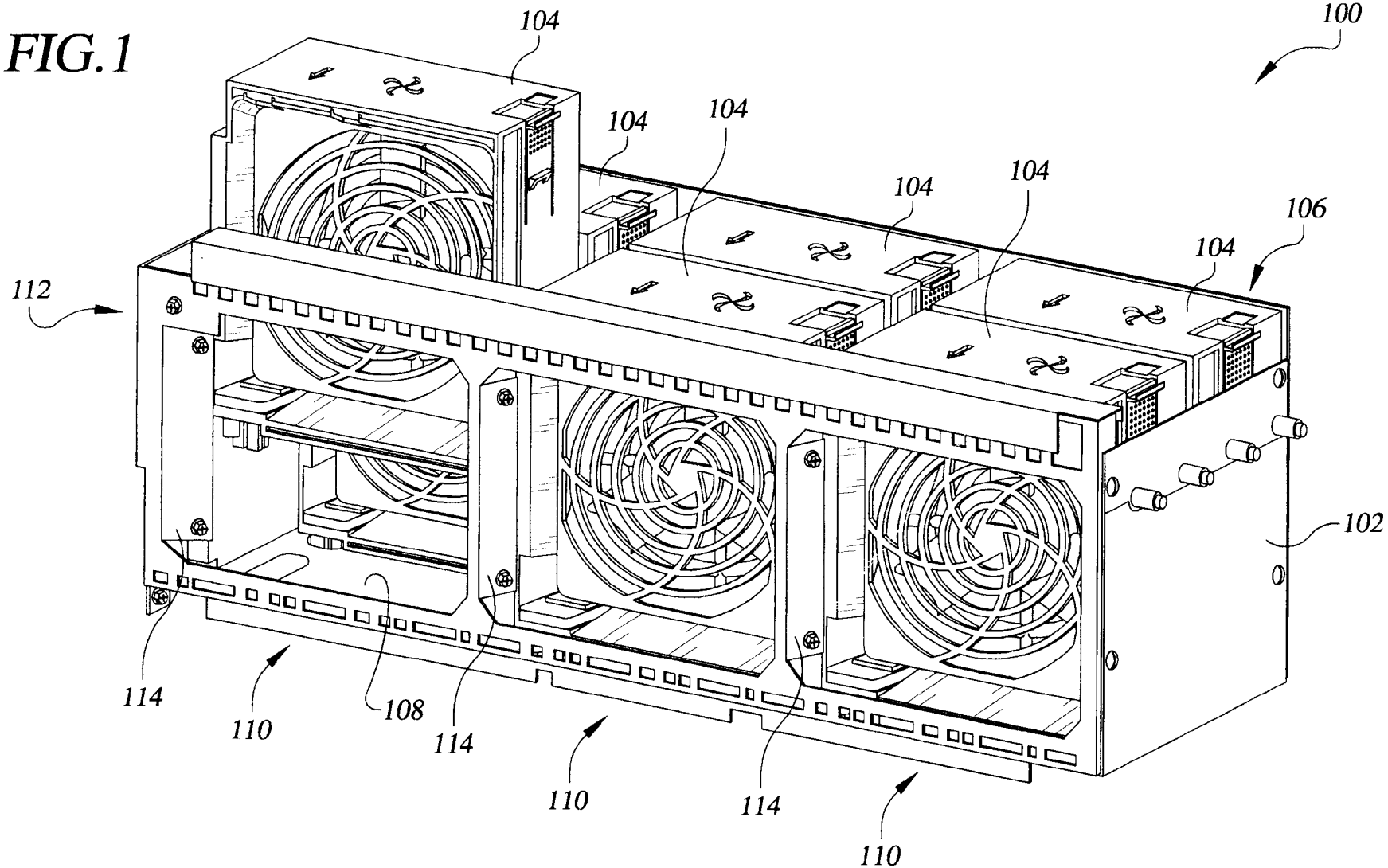
FIG. 1 is a perspective view of a fan package including a plurality of fan modules.

Referring now in more detail to the drawings, in which like numerals indicate corresponding parts throughout the several views, FIG. 1 illustrates a fan package 100 that comprises a fan cage 102 that houses a plurality of field-replaceable fan modules 104. The fan package 100 is sized and configured for installation in a computer and, more particularly, in a computer cabinet (see, e.g., FIG. 8). The fan cage 102 forms a structural housing in which the fan modules 104 may be contained. Although capable of alternative construction, the fan cage 102 may be made from of sheet metal. As indicated in FIG. 1, the fan cage 102 is configured for receipt of six fan modules 104 through an opening 106 formed in the top end of the fan cage. In particular, each fan module 104 may be received in a separate cavity 108 formed in the fan cage 102. Although six such cavities 108, and therefore six fan modules 104, are shown, any number of cavities and modules 104 can be provided depending upon the amount of cooling needed and the space available within the computer.

The fan modules 104 are arranged within the fan cage 102 such that the fan modules are arranged in both series and in parallel. In particular, each fan module 104 is aligned with another fan module in an axial (i.e., airflow) direction of the fan module so that pairs of fan modules force air together in a serial (i.e., additive) manner. In addition, each fan module 104 is positioned next to at least one other fan module in a lateral direction (normal to the axial direction) so that a wider area can be provided with airflow.

The fan cage 102 further includes outlet openings 110 formed at an exit end 112 of the cage. These openings 110 are aligned with the fan modules 104 adjacent the exit end 112 of the cage 102 and permit the passage of air exhausted by the fan modules. On the opposite side of the fan cage 102 (not shown) are provided inlet openings that are similarly aligned with the fan modules 104. As indicated in FIG. 1, the outlet openings 112 of the fan cage 102 may optionally include diffusing surfaces 114 that, as is described below, aid in the diffusion of air downstream of the fan package 100.

Figure 2:
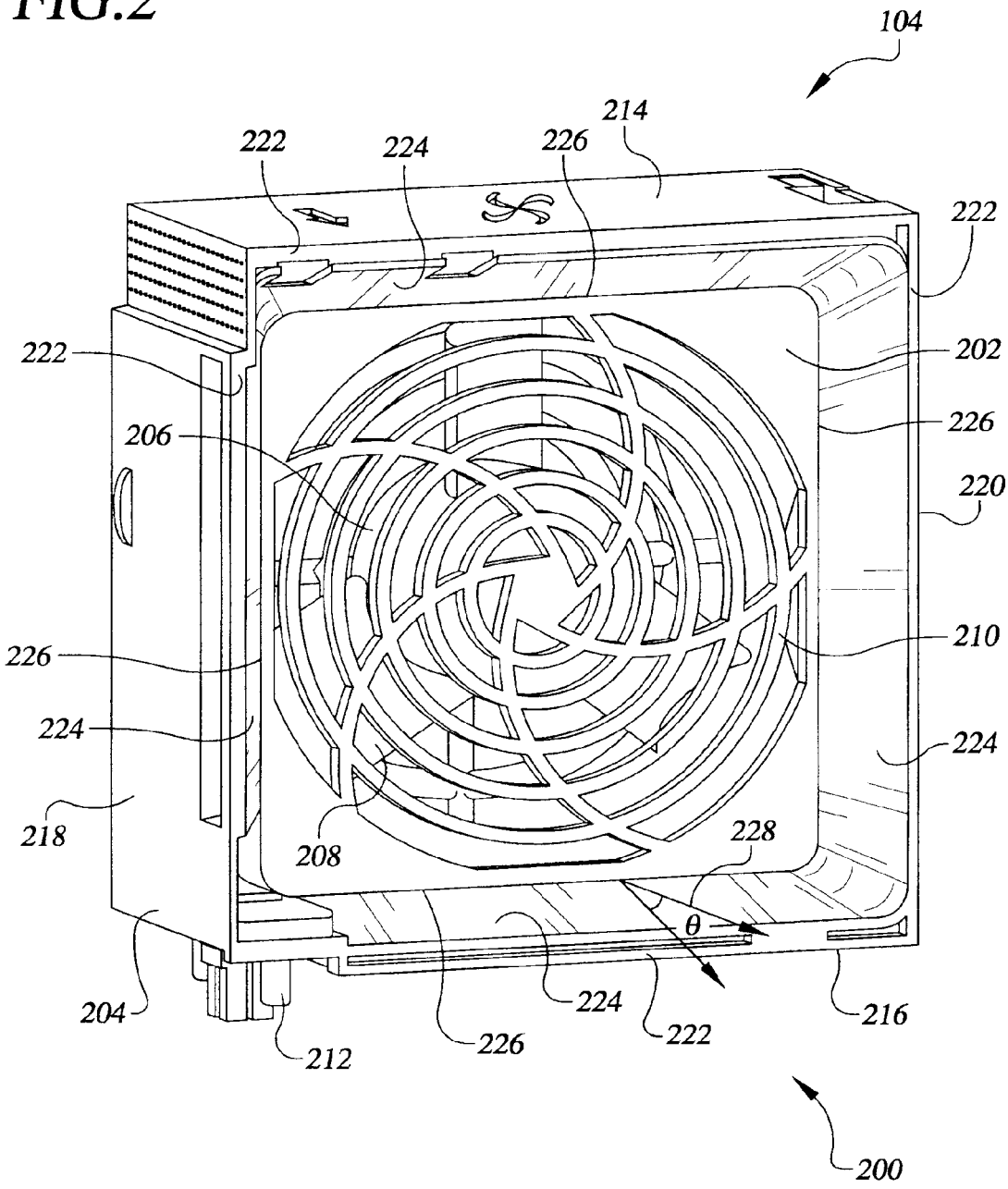
FIG. 2 is a perspective view of an exit end of a fan module shown in FIG. 1.
Figure 3:
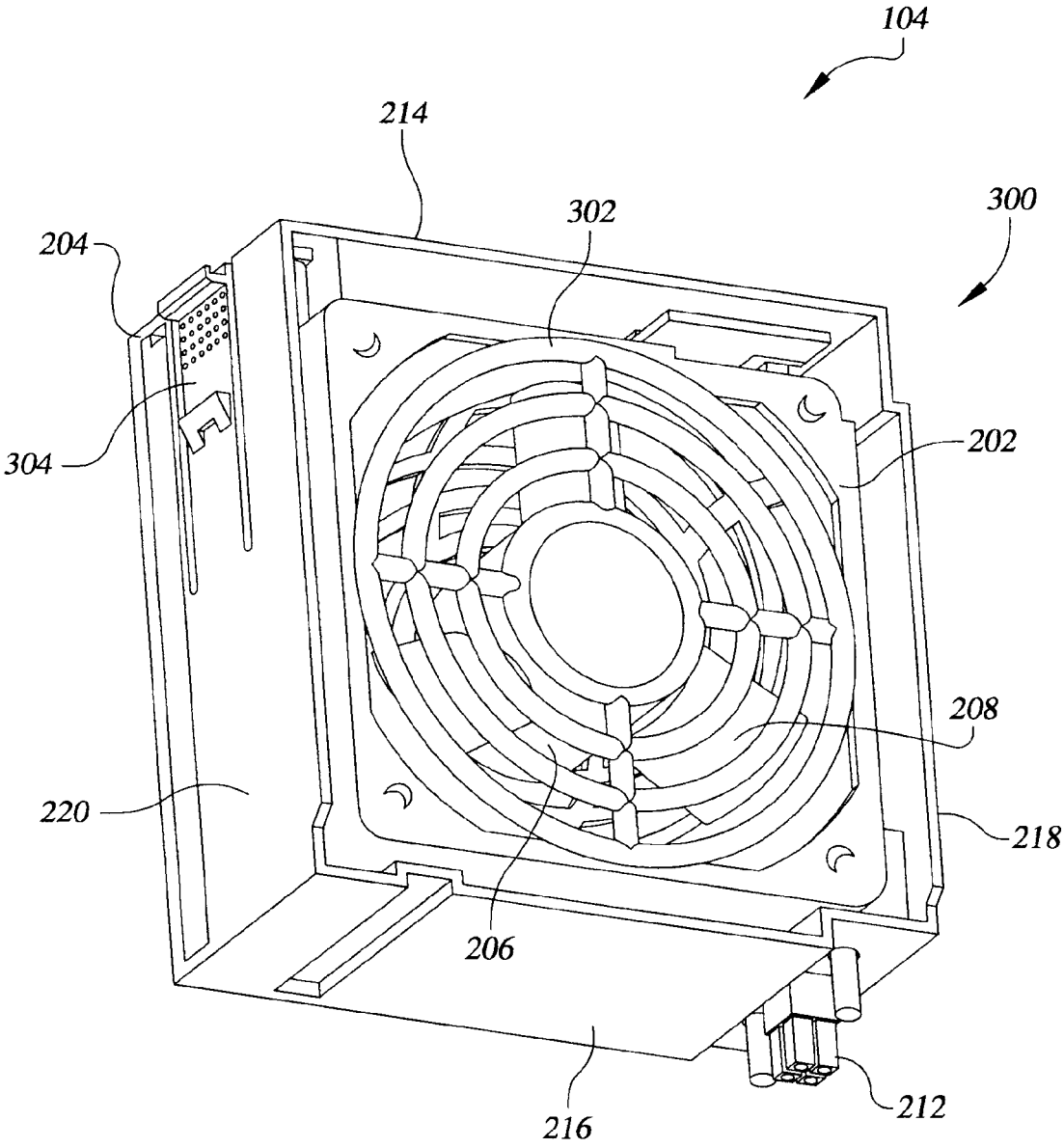
FIG. 3 is a perspective view of an inlet end of the fan module of FIG. 2.

An example fan module 104 is illustrated in detail in FIGS. 2 and 3. In particular, FIG. 2 shows an exit end 200 of the fan module 104, and FIG. 3 shows an inlet end 300 of the fan module. The fan module 104 generally comprises a fan 202 that is housed within a fan housing 204. The fan 202 can comprise substantially any commercially available or custom fan that is capable of generating a forced airflow. By way of example, the fan 202 may comprise fan model FBA09A12U from Panasonic® having width and height dimensions both equal to approximately 92 millimeters (mm) and a depth dimension (in the axial or airflow direction of the fan) of approximately 25.5 mm.

Irrespective of its particular configuration, the fan 202 generally comprises a fan element 206 that comprises a plurality of fan blades 208 that are rotated to generate airflow. Typically, the fan element 206 is interposed between a front grill 302 (FIG. 3) and a rear grill 210 (FIG. 2) that, respectively, define an inlet end and an exit end of the fan. Both of these grills 302, 210 include various openings that allow air to pass. The grills 302, 208 protect the fan element 206 from interference with other components and further protect the fingers of technicians or other persons who access the interior of the computer in which the fan package 100 is installed. The fan 202 typically further includes an integral electrical connector 212 that is used to supply power to an internal motor (not shown) of the fan. As indicated in FIGS. 2 and 3, this connector 212 may extend downwardly from a bottom corner of the fan 202.

The fan housing 204 surrounds the periphery of the fan 202 with a plurality of sides. In the orientation shown in FIGS. 2 and 3, the fan housing 204 comprises a top side 214, a bottom side 216, and first and second lateral sides 218 and 220. Although absolute spatial terms such as "top" and "bottom" are used, it is to be understood that these terms are merely used for convenience to describe the structure of the fan modules 104. Optionally, each of the sides may be integrally formed with and othorgonal to at least two other sides such that the entire housing 204 is unitary. This configuration can be achieved by, for example, forming the fan housing 204 from a polymeric or metal material using a molding or casting process. By way of example, the fan housing 204, and therefore the fan module 104, has outer width, height, and depth dimensions of approximately 112.5 mm, 116 mm, and 52 mm, respectively. On one of the lateral sides (the second lateral side 220 in the embodiment shown in FIGS. 2 and 3) is a resilient latch 304 that is used to lock the fan module 104 in place once inserted into the fan cage 102 in the manner shown in FIG. 1.

As can be appreciated from FIGS. 2 and 3, the fan 202 is positioned within the fan housing 204 such that the fan is generally centered along the axial direction (i.e., airflow direction) of the housing. In that the fan housing 204 has a greater depth dimension than the fan 202, the fan (in particular the rear grill 210 of the fan) is spaced from the outer edge 222 of the fan housing 204 along the exit end 200 of the fan module 104 (FIG. 2). By way of example, this distance is approximately 22 mm. As indicated in FIG. 2, this distance is spanned by angled interior walls 224 of the various sides of the fan housing 204. In particular, the interior walls 224 extend from outer edges 226 of the fan 202 to the outer edges 222 of the housing sides. As indicated in FIG. 2, a portion of one of the interior walls 224 may be removed to accommodate the electrical connector 212 of the fan 202.

In that the width and height dimensions of the fan 202 are smaller than the width and height dimensions of the fan housing 204, the interior walls 224 are angled outwardly in a radial direction away from the fan so as to define diffusing surfaces that diffuse air exhausted by the fan. In particular, as indicated in FIG. 2, the outer surfaces 224 are angled at an angle θ with respect to an axis 228 that is parallel to the axial direction of the fan (and therefore the airflow). This angled arrangement generates an airflow that covers a larger area and that is more evenly distributed (see FIG. 4).

The angle at which the interior walls 224 extend out from the fan 202 is selected to obtain the most optimal diffusion of air for the particular application. What is optimal for this angle depends upon the capabilities (e.g., power) of the fan 202 as well as the nature of the components to be cooled. Therefore, no one angle is considered ideal. For most cases, however, an angle θ of approximately 10° to 45° is effective in diffusing air exhausted by the fan 202 to a desirable extent. For instance, an angle θ of approximately 20° spreads airflow generated by a 92 mm×92 mm fan to an area approximately covered by a 120 mm×120 mm fan. Accordingly, due to the air diffusion provided by the fan housing 204, the coverage typically provided by a given-sized fan may be provided by a smaller-sized fan.

Figure 4:
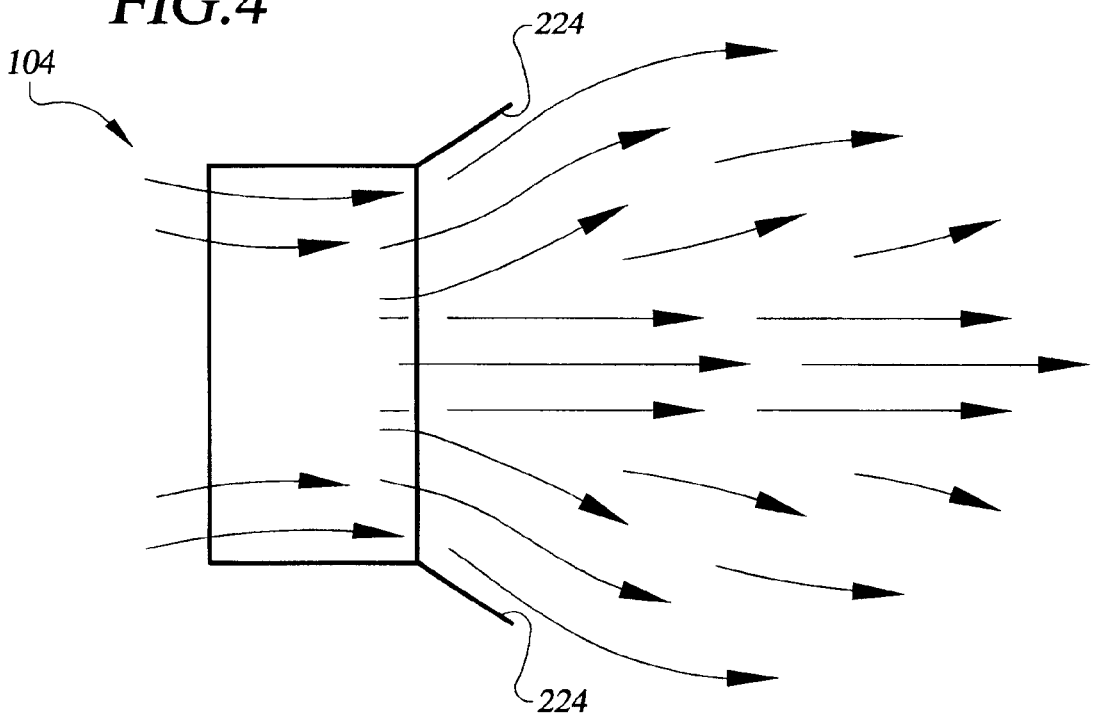
FIG. 4 is a schematic representation of airflow created by the fan module of FIGS. 2 and 3.
Figure 5:
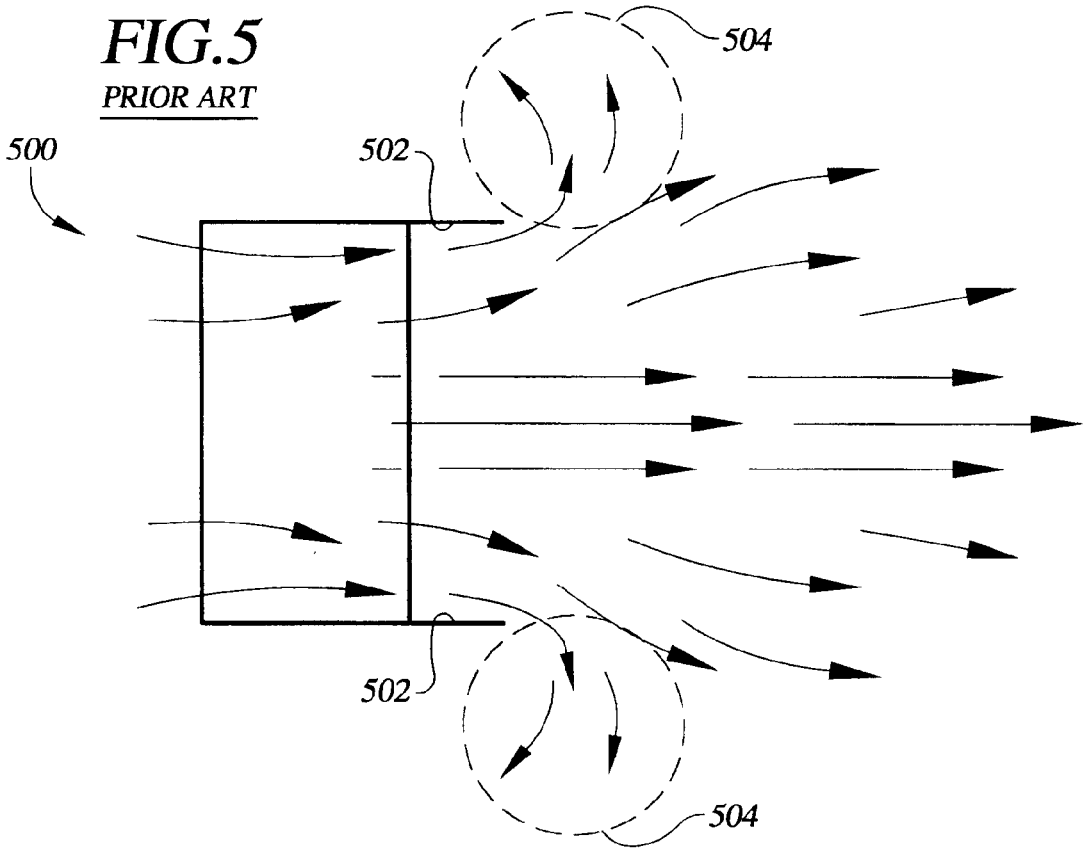
FIG.5 PRIOR ART
FIG. 5 is a schematic representation of airflow created by a prior art fan module.

The effects provided by the angled interior walls 224 of the fan housing 104 are depicted in FIGS. 4–7. In particular, FIGS. 4 and 5 compare airflow through the fan module 104 having angled interior walls 224, and a prior art fan module 500 having straight interior walls 502, respectively. As indicated in FIG. 4, the angled interior walls 224 spread the flow of air downstream of the fan module 104 so that an airflow having an area greater than that of the fan module (width×height) is provided. In contrast, with reference to FIG. 5, the prior art fan module 500 provides a smaller airflow that approximates the area of the fan module. Moreover, the prior art fan module 500 creates air recirculation in areas 504 so that a portion of the airflow is wasted. Accordingly, a portion of the energy used to generate a heat-dissipating airflow fails to reach the components to be cooled thereby indicating an inefficient result.

Figure 6:
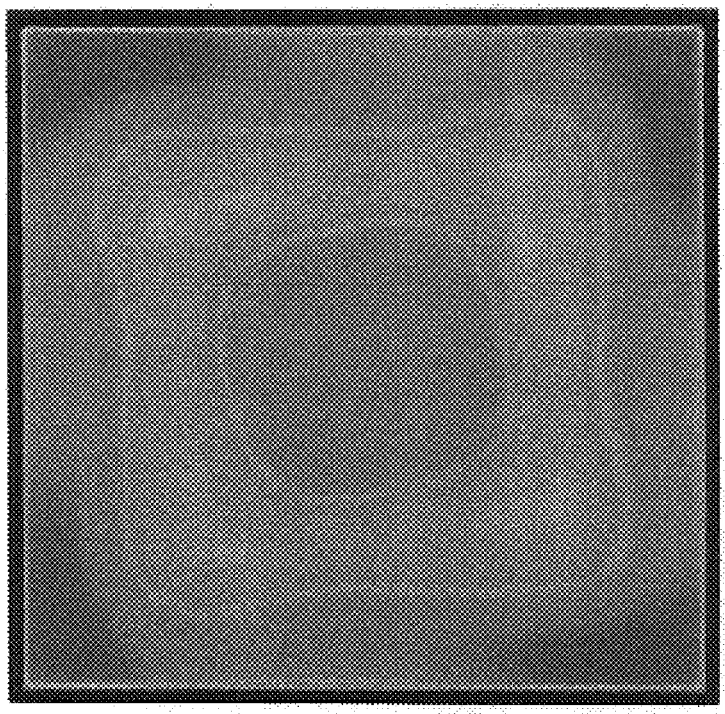
FIG. 6 is an airspeed diagram of airflow created by the fan module of FIGS. 2 and 3.
Figure 7:
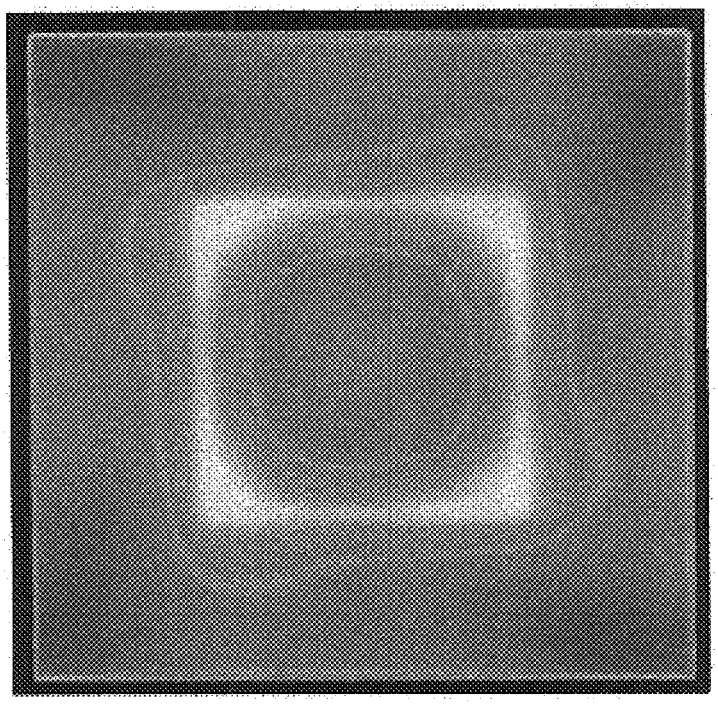
FIG. 7 is an airspeed diagram of airflow created by a prior art fan module.

In addition to expanding the airflow downstream of the fan module 104, the angled interior walls 224 of the disclosed fan module provide more even distribution of airflow. This phenomenon is depicted in FIGS. 6 and 7 that illustrate airspeed of the airflow approximately 30 mm downstream exit ends of the fan 202 of the fan module 204 and the fan of a prior art fan module, respectively. Accordingly, shown are cross-sections of airflows created by the fan module 104 and a prior art fan module. In these figures, blue and green (i.e., dark) colors represent relatively low velocity flow while yellow (i.e., light) color represents relatively high velocity flow. As indicated in FIG. 6, the airspeed of the airflow downstream of the fan module 204 is evenly distributed, as evidenced by the even distribution of blue and green colors throughout the cross-section. In contrast, however, with reference to FIG. 7, the airspeed of the airflow of the prior art fan module is uneven with relatively high speed areas indicated in yellow and relatively low speed areas indicated in green and blue being formed in discrete areas of the cross-section.

With reference back to FIG. 1, the air diffusing provided by the fan modules 104 can be further facilitated by the diffusing surfaces 114.

Figure 8:
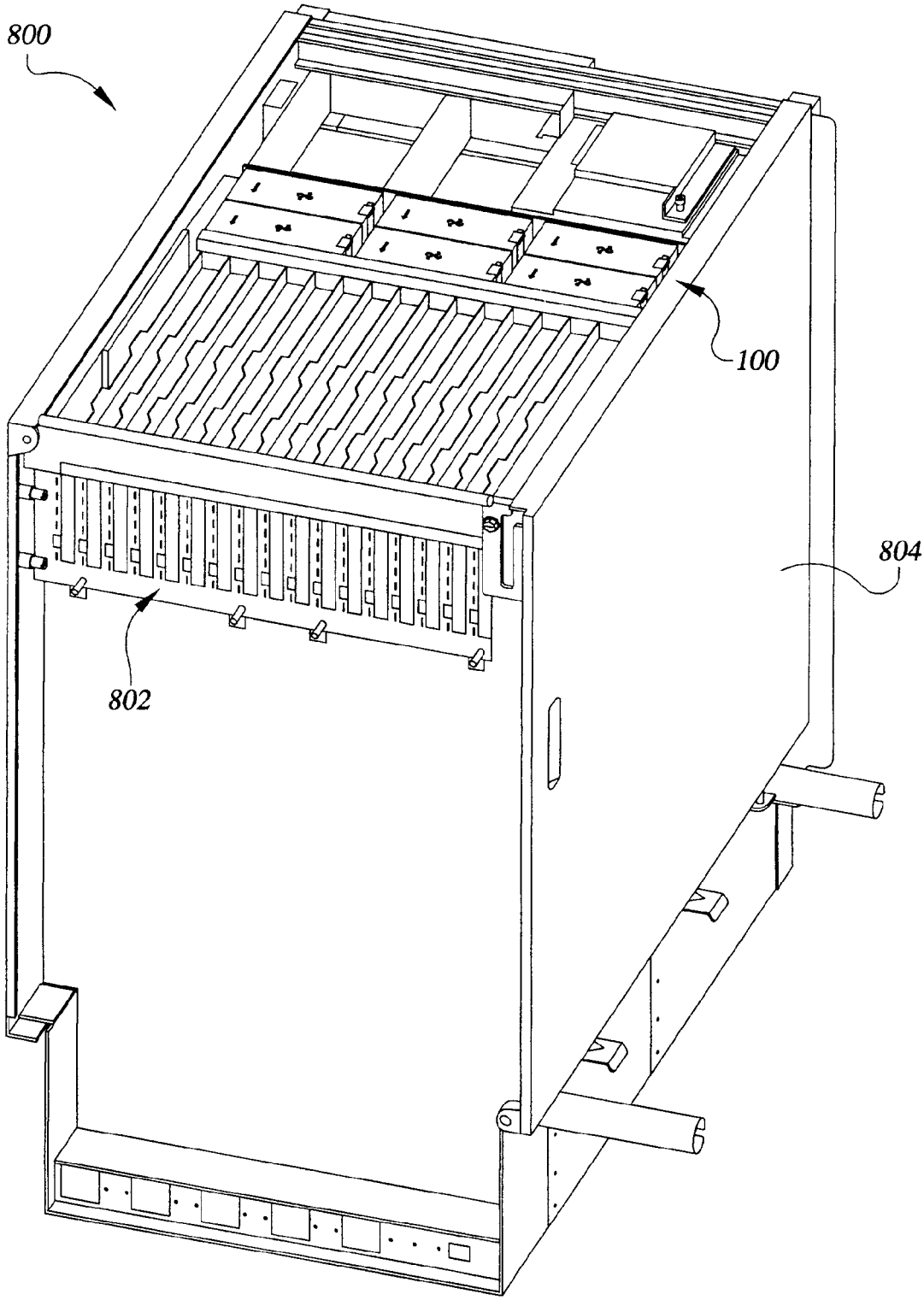
FIG. 8 is a perspective view of a computer that includes the fan package of FIG. 1.

Referring now to FIG. 8, the fan package 100 of FIG. 1 is shown installed in a computer 800, such as a network server. As shown in FIG. 8, the fan package 100 may be used to cool a plurality of cards 802 provided in a card bay of the computer 800. Due to the integrated diffusers of the fan modules 104 described above, a relatively small (i.e., short) fan package 100 can be used within the limited space of the computer cabinet 804 without sacrificing the heat-dissipation capability needed to adequately cool the cards 802 during computer use.

What is claimed is:

1. A fan module, comprising:

a fan having an inlet end and an exit end, the exit end being defined by fan outer edges; and a fan housing in which the fan is positioned, the fan housing including an outer edge and an angled interior wall that extends from one of the fan outer edges toward the outer edge of the fan housing, the angled interior wall extending outwardly in a radial direction away from the fan outer edge so as to diffuses air at a location that is downstream of the exit end of the fan.

2. The fan module of claim 1, wherein the fan housing comprises multiple angled interior walls, each extending from a fan outer edge to the outer edge of the fan housing.

3. The fan module of claim 2, wherein the fan housing comprises multiple sides, an angled interior wall being associated with each of the sides.

4. The fan module of claim 3, wherein the sides of the fan housing and their angled interior walls are integrally formed with each other.

5. The fan module of claim 4, wherein the sides of the fan housing are orthogonally arranged with respect to each other.

6. The fan module of claim 1, wherein the angled interior wall extends outwardly from the outer edge of the exit end of the fan at an angle of approximately 10° to 45° relative to an axis parallel to an axial direction of the fan.

7. The fan module of claim 1, wherein the angled interior wall extends outwardly from the outer edge of the exit end of the fan at an angle of approximately 20° relative to an axis parallel to an axial direction of the fan.

8. The fan module of claim 1, wherein the fan housing comprises a resilient latch used to lock the fan module within a fan cage.

9. A fan module, comprising:

a fan having a fan element including a plurality of fan blades, a front grill that defines an inlet end of the fan, and a rear grill that defines an exit end of the fan, the rear grill comprising a plurality of outer edges; and a fan housing in which the fan is positioned, the fan housing having an inlet end and an exit end that are defined by a plurality of housing sides, each housing side including an angled interior wall that extends from an outer edge of the rear grill to an outer edge of the exit end of the fan housing;

wherein the angled interior walls of the fan housing diffuse air exhausted by the fan so as to increase the area of the airflow created by the fan downstream thereof.

10. The fan module of claim 9, wherein the housing sides and their angled interior walls are integrally formed with each other.

11. The fan module of claim 9, wherein the sides of the fan housing are orthogonal to each other.

12. The fan module of claim 9, wherein the angled interior walls extend outwardly from the outer edges of the rear grill at an angle of approximately 10° to 45° relative to an axis parallel to an axial direction of the fan.

13. The fan module of claim 9, wherein the angled interior walls extend outwardly from the outer edges of the rear grill at an angle of approximately 20° relative to an axis parallel to an axial direction of the fan.

14. The fan module of claim 9, wherein the fan housing comprises a resilient latch formed on one of the housing sides that is used to lock the fan module within a fan cage.

15. A fan housing adapted to receive a fan having an inlet end and an outlet end, the fan housing comprising:

at least one angled interior wall integrally formed with the housing, the at least one angled interior wall being configured to extend radially outward and away from an outer edge of a fan received within the fan housing so as to diffuse airflow created by the fan at a location that is downstream of the fan outer edge.

16. The fan housing of claim 15, wherein the fan housing comprises multiple angled interior walls, each configured to extend from an outer edge of the fan to an outer edge of an exit end of the housing.

17. The fan housing of claim 16, wherein the fan housing comprises multiple sides, an angled interior wall being associated with each of the sides.

18. The fan housing of claim 17, wherein the sides of the fan housing and their angled interior walls are integrally formed with each other.

19. The fan housing of claim 18, wherein the sides of the fan housing are orthogonally arranged with respect to each other.

20. The fan housing of claim 15, wherein the angled interior wall is configured to extend outwardly from the outer edge of the exit end of the fan at an angle of approximately 10° to 45° relative to an axis parallel to an axial direction of the fan.

21. The fan housing of claim 15, further comprising a resilient latch formed integrally with the housing that is used to lock the fan housing within a fan cage.

22. A fan package, comprising:

a fan cage that defines a plurality of cavities each adapted to receive a fan module; and a plurality of fan modules disposed within the cavities of the fan cage, each fan module including:

a fan having an inlet end and an exit end, the exit end defined by fan outer edges, and a fan housing in which the fan is positioned, the fan housing including an outer edge an angled interior wall that extends from one of the fan outer edges toward the outer edge of the fan housing, the angled interior wall extending outwardly in a radial direction away from the fan outer edge so as to diffuse air at a location that is downstream of the exit end of the fan housing.

23. The fan package of claim 22, wherein each fan housing comprises multiple angled interior walls, each extending from a fan outer edge to the outer edge of the fan housing.

24. The fan package of claim 23, wherein each fan housing comprises multiple sides, an angled interior wall being associated with each of the sides.

25. The fan package of claim 24, wherein the sides of each fan housing and their angled interior walls are integrally formed with each other.

26. The fan package of claim 25, wherein the sides of each fan housing are orthogonally arranged with respect to each other.

27. The fan package of claim 22, wherein the angled interior wall of each fan housing extends outwardly from the outer edge of the exit end of the fan disposed in the housing at an angle of approximately 10° to 45° relative to an axis parallel to an axial direction of the fan.

28. The fan package of claim 22, wherein the fan cage defines a plurality of outlet openings, each outlet opening comprising a diffusing surface is aligned that with an angled interior wall of a fan housing.

29. A computer, comprising:

a computer cabinet defining an interior space;

a plurality of heat-generating computer components disposed in the interior space of the computer cabinet; and at least one fan module installed within the interior space of the computer cabinet, the at least one fan module including:

a fan having a fan element including a plurality of fan blades, a front grill that defines an inlet end of the fan, and a rear grill that defines an exit end of the fan, the rear grill comprising a plurality of outer edges, and a fan housing in which the fan is positioned, the fan housing having an inlet end and an exit end that are defined by a plurality of housing sides, each housing side including an angled interior wall that extends from an outer edge of the rear grill to an outer edge of the exit end of the fan housing, wherein the angled interior walls of the fan housing diffuse air exhausted by the fan so as to increase the area of the airflow created by the fan downstream thereof.

* * * * *

UNITED STATES PATENT AND TRADEMARK OFFICE

CERTIFICATE OF CORRECTION

PATENT NO. : 7,021,895 B2
APPLICATION NO. : 10/292989
DATED : April 4, 2006
INVENTOR(S) : Brandon Rubenstein et al.

It is certified that error appears in the above-identified patent and that said Letters Patent is hereby corrected as shown below:

In column 5, line 2, in Claim 1, delete “diffuses” and insert -- diffuse --, therefor.

In column 6, line 33, in Claim 22, delete “housing”.

Signed and Sealed this

Second Day of June, 2009

John Doll

JOHN DOLL
*Acting Director of the United States Patent and Trademark Office*